US009530343B2

(12) United States Patent
Zheng

(10) Patent No.: US 9,530,343 B2
(45) Date of Patent: Dec. 27, 2016

(54) METHOD FOR CORRECTING GRAY-SCALE OF DISPLAY PANEL

(71) Applicant: SHENZHEN CHINA STAR OPTOELECTRONICS TECHNOLOGY CO., LTD., Shenzhen, Guangdong (CN)

(72) Inventor: Hua Zheng, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 227 days.

(21) Appl. No.: 14/406,714

(22) PCT Filed: Jun. 4, 2014

(86) PCT No.: PCT/CN2014/081638

§ 371 (c)(1),
(2) Date: Dec. 9, 2014

(87) PCT Pub. No.: WO2015/196509

PCT Pub. Date: Dec. 30, 2015

(65) Prior Publication Data

US 2016/0260368 A1 Sep. 8, 2016

(30) Foreign Application Priority Data

Jun. 23, 2014 (CN) ..... 2014 1 0284746

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 2320/0285* (2013.01); *G09G 2320/0666* (2013.01)

(58) Field of Classification Search
CPC G09G 3/2003; G09G 3/36; G09G 2320/0666; G09G 2320/0285
See application file for complete search history.

(56) References Cited

U.S. PATENT DOCUMENTS

2007/0247407 A1 10/2007 Lee et al.
2011/0222767 A1* 9/2011 Mitsunaga ..... H04N 1/6027 382/169

FOREIGN PATENT DOCUMENTS

CN 1242557 A 1/2000
CN 1627357 A 6/2005
(Continued)

OTHER PUBLICATIONS

Ke et al., Machine Translation fo Foreign Patent Document CN 101123074 A, Generation method for gamma mapping table, Feb. 13, 2008, pp. 1-5.*
(Continued)

*Primary Examiner* — Dwayne Bost
*Assistant Examiner* — Maheen Javed
(74) *Attorney, Agent, or Firm* — Stein IP, LLC

(57) ABSTRACT

The present disclosure relates to a gray-scale correction method of a display panel, comprising: selecting a plurality of measurement points and specifying a reference point; specifying a plurality of measurement gray-scales, and, under each measurement gray-scale, measuring actual gray-scale of each measurement point when the brightness thereof reaches a reference brightness, wherein the reference brightness is the brightness of the reference point; determining a gray-scale correction coefficient of each measurement point under each measurement gray-scale according to the corresponding relationship between the actual gray-scale and the measurement gray-scale, and establishing an original gray-scale correction coefficient table; extending the original gray-scale correction coefficient table to a gray-scale correction coefficient table of pixel points of the display panel under all gray-scales through linear interpolation algorithm;
(Continued)

| The gray-scale correction coefficients | | The pixel points | | | | | | | | |
|---|---|---|---|---|---|---|---|---|---|---|
| | | $< \frac{N}{2n}$ | $\frac{N}{2n}$ | ... | $\frac{pN}{2n}$ | $\frac{pN}{2n} < x < \frac{(p+1)N}{2n}$ | $\frac{(p+1)N}{2n}$ | ... | $\frac{(2n-1)N}{2n}$ | $> \frac{(2n-1)N}{2n}$ |
| The gray-scales | $< L_1$ | $C_{\frac{N}{2n}}(L_1)$ | $C_{\frac{N}{2n}}(L_1)$ | ... | $C_{\frac{pN}{2n}}(L_1)$ | $C_x(L_1)$ | $C_{\frac{(p+1)N}{2n}}(L_1)$ | ... | $C_{\frac{(2n-1)N}{2n}}(L_1)$ | $C_{\frac{(2n-1)N}{2n}}(L_1)$ |
| | $L_1$ | $C_{\frac{N}{2n}}(L_1)$ | $C_{\frac{N}{2n}}(L_1)$ | ... | $C_{\frac{pN}{2n}}(L_1)$ | $C_x(L_1)$ | $C_{\frac{(p+1)N}{2n}}(L_1)$ | ... | $C_{\frac{(2n-1)N}{2n}}(L_1)$ | $C_{\frac{(2n-1)N}{2n}}(L_1)$ |
| | ... | ... | ... | ... | ... | ... | ... | ... | ... | ... |
| | $L_q$ | $C_{\frac{N}{2n}}(L_q)$ | $C_{\frac{N}{2n}}(L_q)$ | ... | $C_{\frac{pN}{2n}}(L_q)$ | $C_x(L_q)$ | $C_{\frac{(p+1)N}{2n}}(L_q)$ | ... | $C_{\frac{(2n-1)N}{2n}}(L_q)$ | $C_{\frac{(2n-1)N}{2n}}(L_q)$ |
| | $L_q < y < L_{q+1}$ | $C_{\frac{N}{2n}}(y)$ | $C_{\frac{N}{2n}}(y)$ | ... | $C_{\frac{pN}{2n}}(y)$ | $C_x(y)$ | $C_{\frac{(p+1)N}{2n}}(y)$ | ... | $C_{\frac{(2n-1)N}{2n}}(y)$ | $C_{\frac{(2n-1)N}{2n}}(y)$ |
| | $L_{q+1}$ | $C_{\frac{N}{2n}}(L_{q+1})$ | $C_{\frac{N}{2n}}(L_{q+1})$ | ... | $C_{\frac{pN}{2n}}(L_{q+1})$ | $C_x(L_{q+1})$ | $C_{\frac{(p+1)N}{2n}}(L_{q+1})$ | ... | $C_{\frac{(2n-1)N}{2n}}(L_{q+1})$ | $C_{\frac{(2n-1)N}{2n}}(L_{q+1})$ |
| | ... | ... | ... | ... | ... | ... | ... | ... | ... | ... |
| | $L_m$ | $C_{\frac{N}{2n}}(L_m)$ | $C_{\frac{N}{2n}}(L_m)$ | ... | $C_{\frac{pN}{2n}}(L_m)$ | $C_x(L_m)$ | $C_{\frac{(p+1)N}{2n}}(L_m)$ | ... | $C_{\frac{(2n-1)N}{2n}}(L_m)$ | $C_{\frac{(2n-1)N}{2n}}(L_m)$ |
| | $> L_m$ | $C_{\frac{N}{2n}}(L_m)$ | $C_{\frac{N}{2n}}(L_m)$ | ... | $C_{\frac{pN}{2n}}(L_m)$ | $C_x(L_m)$ | $C_{\frac{(p+1)N}{2n}}(L_m)$ | ... | $C_{\frac{(2n-1)N}{2n}}(L_m)$ | $C_{\frac{(2n-1)N}{2n}}(L_m)$ |

when a data voltage is to be applied to a pixel point under a gray-scale, searching the gray-scale correction coefficient corresponding to said gray-scale and said pixel point from the extended gray-scale correction coefficient table, correcting the value of said gray-scale accordingly, and driving the display panel according to the corrected gray-scale.

17 Claims, 8 Drawing Sheets

(56) References Cited

FOREIGN PATENT DOCUMENTS

| | | | |
|---|---|---|---|
| CN | 1755758 | A | 4/2006 |
| CN | 101089683 | A | 12/2007 |
| CN | 101123074 | A | 2/2008 |
| CN | 101325024 | A | 12/2008 |
| CN | 101425266 | A | 5/2009 |
| CN | 101859526 | A | 10/2010 |
| CN | 102196175 | A | 9/2011 |
| CN | 103314405 | A | 9/2013 |
| JP | 2006243223 | A | 9/2006 |
| JP | 2006276119 | A | 10/2006 |
| JP | 2007199470 | A | 8/2007 |

OTHER PUBLICATIONS

Chinese Office Action with search report dated Nov. 16, 2015, issued Chinese Patent Office in corresponding application 201410284746.X.

International Search Report dated Mar. 24, 2015.

* cited by examiner

| The gray-scale correction coefficients | | The measurement points | | | | | | |
|---|---|---|---|---|---|---|---|---|
| | | 1 | 2 | … | n | … | 2n-2 | 2n-1 |
| The measurement gray-scales | $L_1$ | $C_1(L_1)$ | $C_2(L_1)$ | … | $C_n(L_1)$ | … | $C_{2n-2}(L_1)$ | $C_{2n-1}(L_1)$ |
| | $L_2$ | $C_1(L_2)$ | $C_2(L_2)$ | … | $C_n(L_2)$ | … | $C_{2n-2}(L_2)$ | $C_{2n-1}(L_2)$ |
| | … | … | … | … | …… | … | … | … |
| | $L_{m-1}$ | $C_1(L_{m-1})$ | $C_2(L_{m-1})$ | … | $C_n(L_{m-1})$ | … | $C_{2n-2}(L_{m-1})$ | $C_{2n-1}(L_{m-1})$ |
| | $L_m$ | $C_1(L_m)$ | $C_2(L_m)$ | … | $C_n(L_m)$ | … | $C_{2n-2}(L_m)$ | $C_{2n-1}(L_m)$ |

Fig. 4

| The gray-scale correction coefficients | | The measurement pixel points | | | | | | |
|---|---|---|---|---|---|---|---|---|
| | | $\frac{N}{2n}$ | $\frac{2N}{2n}$ | ... | $\frac{nN}{2n}$ | ... | $\frac{(2n-2)N}{2n}$ | $\frac{(2n-1)N}{2n}$ |
| The measurement gray-scales | $L_1$ | $C_{\frac{N}{2n}}(L_1)$ | $C_{\frac{2N}{2n}}(L_1)$ | ... | $C_{\frac{nN}{2n}}(L_1)$ | ... | $C_{\frac{(2n-2)N}{2n}}(L_1)$ | $C_{\frac{(2n-1)N}{2n}}(L_1)$ |
| | $L_2$ | $C_{\frac{N}{2n}}(L_2)$ | $C_{\frac{2N}{2n}}(L_2)$ | ... | $C_{\frac{nN}{2n}}(L_2)$ | ... | $C_{\frac{(2n-2)N}{2n}}(L_2)$ | $C_{\frac{(2n-1)N}{2n}}(L_2)$ |
| | ... | ... | ... | ... | ..... | ... | ..... | ..... |
| | $L_{m-1}$ | $C_{\frac{N}{2n}}(L_{m-1})$ | $C_{\frac{2N}{2n}}(L_{m-1})$ | ... | $C_{\frac{nN}{2n}}(L_{m-1})$ | ... | $C_{\frac{(2n-2)N}{2n}}(L_{m-1})$ | $C_{\frac{(2n-1)N}{2n}}(L_{m-1})$ |
| | $L_m$ | $C_{\frac{N}{2n}}(L_m)$ | $C_{\frac{2N}{2n}}(L_m)$ | ... | $C_{\frac{nN}{2n}}(L_m)$ | ... | $C_{\frac{(2n-2)N}{2n}}(L_m)$ | $C_{\frac{(2n-1)N}{2n}}(L_m)$ |

Fig. 5

| The gray-scale correction coefficients | | The pixel points | | | | | | | | |
|---|---|---|---|---|---|---|---|---|---|---|
| | | $< \frac{N}{2n}$ | $\frac{N}{2n}$ | … | $\frac{pN}{2n}$ | $\frac{pN}{2n} < x < \frac{(p+1)N}{2n}$ | $\frac{(p+1)N}{2n}$ | … | $\frac{(2n-1)N}{2n}$ | $> \frac{(2n-1)N}{2n}$ |
| The gray-scales | $< L_1$ | $C_{\frac{N}{2n}}(L_1)$ | $C_{\frac{N}{2n}}(L_1)$ | … | $C_{\frac{pN}{2n}}(L_1)$ | $C_x(L_1)$ | $C_{\frac{(p+1)N}{2n}}(L_1)$ | … | $C_{\frac{(2n-1)N}{2n}}(L_1)$ | $C_{\frac{(2n-1)N}{2n}}(L_1)$ |
| | $L_1$ | $C_{\frac{N}{2n}}(L_1)$ | $C_{\frac{N}{2n}}(L_1)$ | … | $C_{\frac{pN}{2n}}(L_1)$ | $C_x(L_1)$ | $C_{\frac{(p+1)N}{2n}}(L_1)$ | … | $C_{\frac{(2n-1)N}{2n}}(L_1)$ | $C_{\frac{(2n-1)N}{2n}}(L_1)$ |
| | … | … | … | … | … | … | … | … | … | … |
| | $L_q$ | $C_{\frac{N}{2n}}(L_q)$ | $C_{\frac{N}{2n}}(L_q)$ | … | $C_{\frac{pN}{2n}}(L_q)$ | $C_x(L_q)$ | $C_{\frac{(p+1)N}{2n}}(L_q)$ | … | $C_{\frac{(2n-1)N}{2n}}(L_q)$ | $C_{\frac{(2n-1)N}{2n}}(L_q)$ |
| | $L_q < y < L_{q+1}$ | $C_{\frac{N}{2n}}(y)$ | $C_{\frac{N}{2n}}(y)$ | … | $C_{\frac{pN}{2n}}(y)$ | $C_x(y)$ | $C_{\frac{(p+1)N}{2n}}(y)$ | … | $C_{\frac{(2n-1)N}{2n}}(y)$ | $C_{\frac{(2n-1)N}{2n}}(y)$ |
| | $L_{q+1}$ | $C_{\frac{N}{2n}}(L_{q+1})$ | $C_{\frac{N}{2n}}(L_{q+1})$ | … | $C_{\frac{pN}{2n}}(L_{q+1})$ | $C_x(L_{q+1})$ | $C_{\frac{(p+1)N}{2n}}(L_{q+1})$ | … | $C_{\frac{(2n-1)N}{2n}}(L_{q+1})$ | $C_{\frac{(2n-1)N}{2n}}(L_{q+1})$ |
| | … | … | … | … | … | … | … | … | … | … |
| | $L_m$ | $C_{\frac{N}{2n}}(L_m)$ | $C_{\frac{N}{2n}}(L_m)$ | … | $C_{\frac{pN}{2n}}(L_m)$ | $C_x(L_m)$ | $C_{\frac{(p+1)N}{2n}}(L_m)$ | … | $C_{\frac{(2n-1)N}{2n}}(L_m)$ | $C_{\frac{(2n-1)N}{2n}}(L_m)$ |
| | $> L_m$ | $C_{\frac{N}{2n}}(L_m)$ | $C_{\frac{N}{2n}}(L_m)$ | … | $C_{\frac{pN}{2n}}(L_m)$ | $C_x(L_m)$ | $C_{\frac{(p+1)N}{2n}}(L_m)$ | … | $C_{\frac{(2n-1)N}{2n}}(L_m)$ | $C_{\frac{(2n-1)N}{2n}}(L_m)$ |

Fig. 6

| The gray-scale correction coefficients | | The measurement points | | |
|---|---|---|---|---|
| | | 1 | 2 | 3 |
| The measurement gray-scales | $L_1$=48 | $C_1(48)$=0.85 | $C_2(48)$=1 | $C_3(48)$=0.86 |
| | $L_2$=96 | $C_1(96)$=0.80 | $C_2(96)$=1 | $C_3(96)$=0.82 |
| | $L_3$=160 | $C_1(160)$=0.75 | $C_2(160)$=1 | $C_3(160)$=0.76 |

Fig. 7

| The gray-scale correction coefficients | | The measurement points | | |
|---|---|---|---|---|
| | | 480 | 960 | 1440 |
| The measurement gray-scales | $L_1$=48 | $C_{480}(48)$=0.85 | $C_{960}(48)$=1 | $C_{1440}(48)$=0.86 |
| | $L_2$=96 | $C_{480}(96)$=0.80 | $C_{960}(96)$=1 | $C_{1440}(96)$=0.82 |
| | $L_3$=160 | $C_{480}(160)$=0.75 | $C_{960}(160)$=1 | $C_{1440}(160)$=0.76 |

Fig. 8

| The gray-scale correction coefficients | | The pixel points | | | | | | | | |
|---|---|---|---|---|---|---|---|---|---|---|
| | | 1~479 | 480 | 481 ~ 959 | 960 | 961 ~ 1014 | x=1015 | 1016 ~ 1439 | 1440 | 1441~1920 |
| The gray-scales | 0~47 | $C_{480}(48)=0.85$ | $C_{480}(48)=0.85$ | … | $C_{960}(48)=1$ | … | $C_{1015}(48)=0.98$ | … | $C_{1440}(48)=0.86$ | $C_{1440}(48)=0.86$ |
| | 48 | $C_{480}(48)=0.85$ | $C_{480}(48)=0.85$ | … | $C_{960}(48)=1$ | … | $C_{1015}(48)=0.98$ | … | $C_{1440}(48)=0.86$ | $C_{1440}(48)=0.86$ |
| | 49~95 | … | … | … | … | … | … | … | … | … |
| | 96 | $C_{480}(96)=0.80$ | $C_{480}(96)=0.80$ | … | $C_{960}(96)=1$ | | $C_{1015}(96)=0.98$ | … | $C_{1440}(96)=0.82$ | $C_{1440}(96)=0.82$ |
| | 97~136 | … | … | … | … | … | … | … | … | … |
| | y=137 | $C_{480}(137)=0.77$ | $C_{480}(137)=0.77$ | … | $C_{960}(137)=1$ | … | $C_{1015}(137)=0.97$ | … | $C_{1440}(137)=0.78$ | $C_{1440}(137)=0.78$ |
| | 138~159 | … | … | … | … | … | … | … | … | … |
| | 160 | $C_{480}(160)=0.75$ | $C_{480}(160)=0.75$ | … | $C_{960}(160)=1$ | … | $C_{1015}(160)=0.97$ | … | $C_{1440}(160)=0.76$ | $C_{1440}(160)=0.76$ |
| | 161~255 | $C_{480}(160)=0.75$ | $C_{480}(160)=0.75$ | … | $C_{960}(160)=1$ | … | $C_{1015}(160)=0.97$ | … | $C_{1440}(160)=0.76$ | $C_{1440}(160)=0.76$ |

Fig. 9

METHOD FOR CORRECTING GRAY-SCALE OF DISPLAY PANEL

The present application claims benefit of Chinese patent application CN 201410284746.X, entitled "A Method for Correcting Gray-scale of Display Panel" and filed on Jun. 23, 2014, which is incorporated herein by reference.

FIELD OF THE INVENTION

The present disclosure relates to the technique of driving liquid crystal display panels, particularly to a gray-scale correction method which can improve the phenomenon of "becoming white near the left and right sides" in liquid crystal display panels.

BACKGROUND OF THE INVENTION

Currently, the liquid crystal display panel develops rapidly toward large size and high resolution. As shown in FIG. 1, for a large size liquid crystal display device, the chips packaged with scan driving circuits therein are usually arranged on the left and right sides of the display panel, for providing scanning signals to the display panel through scanning wirings connected thereto. As the scanning wiring itself has a certain impedance, the waveform of the scanning signal, which is inputted from the left and right sides of the display panel, will suffer from distortion to a certain extent when the scanning signal arrives at the middle part of the display panel. Generally speaking, the larger the size of the display panel, the more serious the distortion of the scanning signal, and the lower the charging rate of the pixel points in the middle part of the display panel. This leads to a phenomenon that the brightness is relatively high at the left and right sides of the display panel but is relatively low at the middle part of the display panel in low gray-scale display. Such phenomenon of non-uniform brightness is usually called "becoming white near the left and right sides".

Therefore, how to improve the phenomenon of "becoming white near the left and right sides" is an important subject to raise the picture quality of the liquid crystal display panel.

SUMMARY OF THE INVENTION

In the light of the above problems, the present disclosure provides a method for correcting gray-scale of a display panel.

The method for correcting gray-scale of a display panel comprises the steps of:

S100, selecting a plurality of measurement points of the display panel and specifying a reference point;

S200, specifying a plurality of measurement gray-scales, and, under each measurement gray-scale, measuring actual gray-scale of each measurement point when the brightness thereof reaches a reference brightness, wherein the reference brightness is the brightness of the reference point;

S300, determining a gray-scale correction coefficient of each measurement point under each measurement gray-scale according to the corresponding relationship between the actual gray-scale and the measurement gray-scale, and establishing an original gray-scale correction coefficient table;

S400, extending the original gray-scale correction coefficient table to a gray-scale correction coefficient table of pixel points of the display panel under all gray-scales through linear interpolation algorithm; and S500, when a data voltage is to be applied to a pixel point under a gray-scale, searching the gray-scale correction coefficient corresponding to said gray-scale and said pixel point from the extended gray-scale correction coefficient table, correcting the value of said gray-scale accordingly, and driving the display panel according to the corrected gray-scale.

Further, the gray-scale correction coefficients of pixel points in the same column of the display panel are the same.

In one embodiment of the present disclosure, said step S100 further comprises adjusting the gray-scale brightness curve of the reference point to meet the standard of γ 2.2.

In one embodiment of the present disclosure, said step S100 comprises:

dividing the display panel into 2n−1 squares with equal area along its horizontal central axis, wherein n≥2, and selecting the central point of each square as the measurement point, and specifying the central point of square n as the reference point.

In one embodiment of the present disclosure, the gray-scale correction coefficient in S300 is the ratio of the actual gray-scale to the corresponding measurement gray-scale.

In one embodiment of the present disclosure, in step S400 the original gray-scale correction coefficient table is extended through linear interpolation algorithm, and in the extended gray-scale correction coefficient table:

the gray-scale correction coefficients of pixel points between any two adjacent measurement points change linearly; and the gray-scale correction coefficients of gray-scales between any two adjacent measurement gray-scales change linearly.

In one embodiment of the present disclosure, in step S400 the original gray-scale correction coefficient table is extended through linear interpolation algorithm, and in the extended gray-scale correction coefficient table:

the gray-scale correction coefficient of the pixel point on the left side of the leftmost measurement point of the display panel equals to the gray-scale correction coefficient of the leftmost measurement point of the display panel; and the gray-scale correction coefficient of the pixel point on the right side of the rightmost measurement point of the display panel equals to the gray-scale correction coefficient of the rightmost measurement point of the display panel.

In one embodiment of the present disclosure, in step S400 the original gray-scale correction coefficient table is extended through linear interpolation algorithm, and in the extended gray-scale correction coefficient table:

the gray-scale correction coefficient of gray-scale smaller than the minimum measurement gray-scale equals to the gray-scale correction coefficient of the minimum measurement gray-scale; and the gray-scale correction coefficient of gray-scale larger than the maximum measurement gray-scale equals to the gray-scale correction coefficient of the maximum measurement gray-scale.

In one embodiment of the present disclosure, the gray-scale correction coefficients inserted in the extended gray-scale correction coefficient table in step S400 are determined by the following equations:

$$C_x(L_q) = A(x)C_{\frac{(p+1)N}{2n}}(L_q) + [1 - A(x)]C_{\frac{pN}{2n}}(L_q)$$

$$C_{\frac{pN}{2n}}(y) = B(y)C_{\frac{pN}{2n}}(L_{q+1}) + [1 - B(y)]C_{\frac{pN}{2n}}(L_q)$$

-continued $$C_x(y) = A(x)B(y)C_{\frac{(p+1)N}{2n}}(L_{q+1}) + [1 - A(x)]B(y)C_{\frac{pN}{2n}}(L_{q+1}) + A(x)[1 - B(y)]C_{\frac{(p+1)N}{2n}}(L_q) + [1 - A(x)][1 - B(y)]C_{\frac{pN}{2n}}(L_q)$$

$$A(x) = \frac{2nx}{N} - p,$$

$$B(y) = \frac{y - L_q}{L_{q+1} - L_q}$$

wherein Lq and Lq+1 represent two adjacent measurement gray-scales;

$$\frac{pN}{2n} \text{ and } \frac{(p+1)N}{2n}$$

represent two adjacent measurement pixel points;

Cx(y) represents the gray-scale correction coefficient of pixel point x under gray-scale y; and N represents the column of display panel, and 2n−1 represents the number of measurement points, p being integer.

In one embodiment of the present disclosure, in step S500 the corrected gray-scale is the product of the original gray-scale and the gray-scale correction coefficient.

In the display panel gray-scale correction method according to the present disclosure, a gray-scale correction coefficient table of a small amount of measurement points can be established based on the test results of the gray-scales and brightness of a small amount of measurement points of the display panel, and then the gray-scale correction coefficient table of a small amount of measurement points can be extended to the gray-scale correction coefficient table of all pixel points through linear interpolation algorithm. In this manner, a gray-scale correction for each pixel point of the display panel with a high correction precision can be achieved, and the phenomenon of "becoming white near the left and right sides" that would occur in the prior art can be improved.

Other features and advantages of the present disclosure will be stated in the following description, and part of them will become obvious in the description or become understood through the embodiments of the present disclosure. The objectives and other advantages of the present disclosure can be achieved and obtained through the structures specified in the description, claims and drawings.

BRIEF DESCRIPTION OF THE DRAWINGS

The accompanying drawings provide further understandings of the present disclosure and constitute one part of the description. The drawings are used to interpret the present disclosure together with the embodiments, not to limit the present disclosure. In the drawings:

FIG. 4 is an original gray-scale correction coefficient table obtained according to S300 of FIG. 2;

FIG. 5 is a rewritten original gray-scale correction coefficient table obtained according to FIG. 4;

FIG. 6 is an extended gray-scale correction coefficient table obtained according to FIG. 5;

FIG. 7 is an original gray-scale correction coefficient table obtained according to S300 of FIG. 2 in one embodiment of the present disclosure;

FIG. 8 is a rewritten original gray-scale correction coefficient table obtained according to FIG. 7; and FIG. 9 is an extended gray-scale correction coefficient table obtained according to FIG. 8.

DETAILED DESCRIPTION OF THE EMBODIMENTS

The technical solution and operating principle provided by the present disclosure will be explained in detail below with reference to the drawings.

Figure 1:
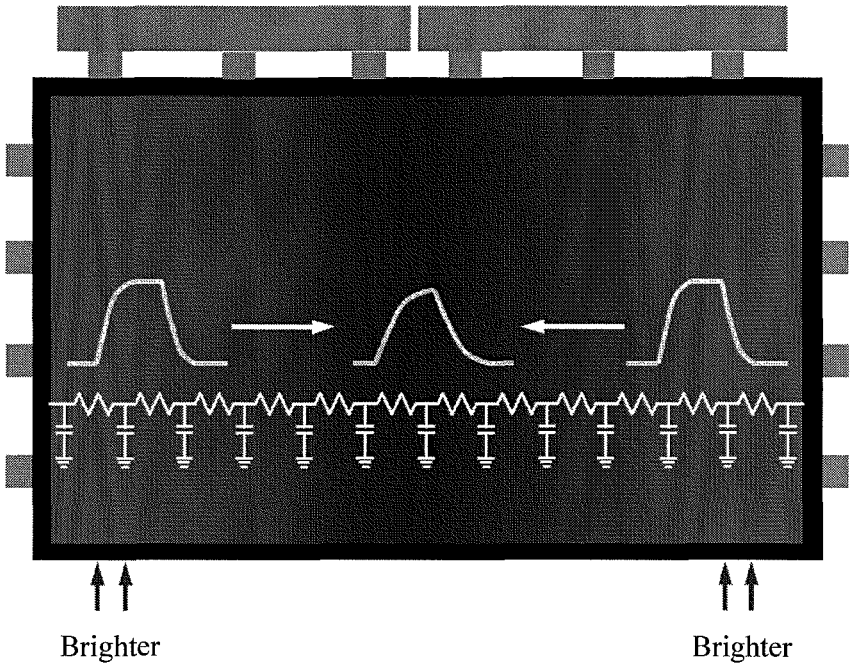
FIG. 1 is an effect diagram of the phenomenon of "becoming white near the left and right sides" of the liquid crystal display panel.
Figure 2:
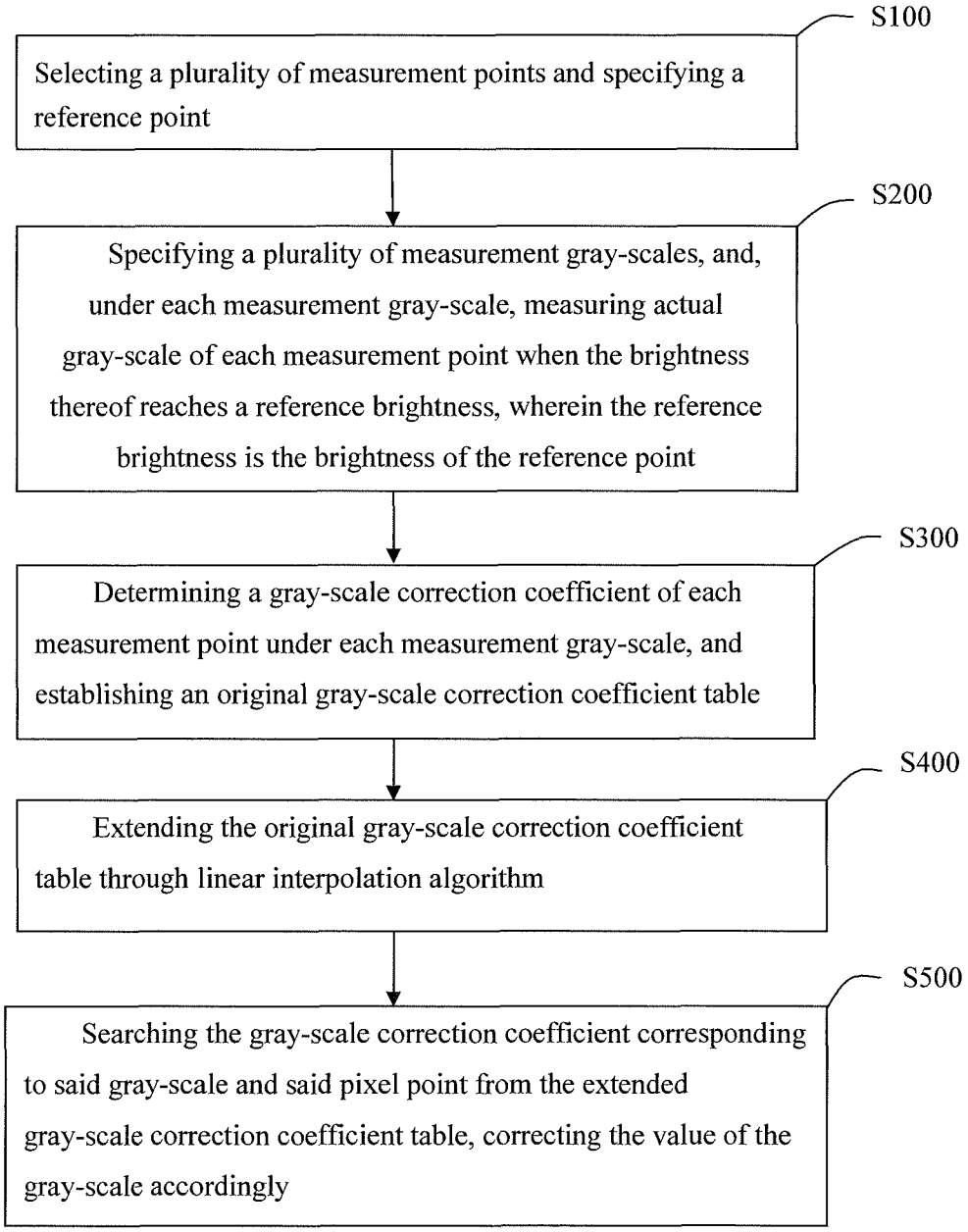
FIG. 2 is a work flow chart of a gray-scale correction method of the display panel provided by the present disclosure.

FIG. 2 is a work flow diagram of a gray-scale correction method of the display panel provided by the present disclosure. The method comprises the following steps:

S100, selecting a plurality of measurement points of the display panel and specifying a reference point;

S200, specifying a plurality of measurement gray-scales, and, under each measurement gray-scale, measuring actual gray-scale of each measurement point when the brightness thereof reaches a reference brightness, wherein the reference brightness is the brightness of the reference point;

S300, determining a gray-scale correction coefficient of each measurement point under each measurement gray-scale according to the corresponding relationship between the actual gray-scale and the measurement gray-scale, and establishing an original gray-scale correction coefficient table;

S400, extending the original gray-scale correction coefficient table to a gray-scale correction coefficient table of pixel points of the display panel under all gray-scales through linear interpolation algorithm; and

S500, when a data voltage is to be applied to a pixel point under a gray-scale, searching the gray-scale correction coefficient corresponding to said gray-scale and said pixel point from the extended gray-scale correction coefficient table, correcting the value of said gray-scale accordingly, and driving the display panel according to the corrected gray-scale.

The above steps can be further subdivided in specific embodiments.

Figure 3:
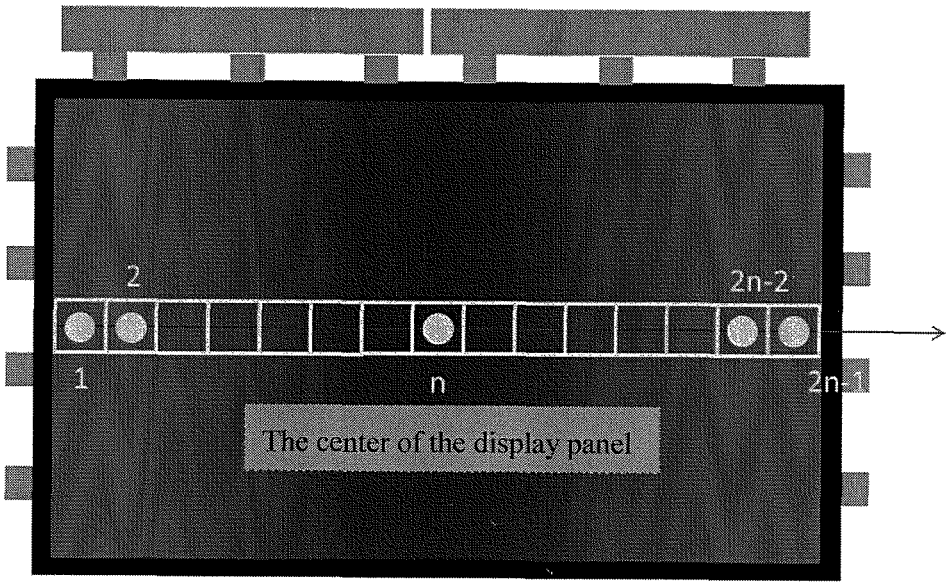
FIG. 3 is a schematic diagram of the measurement points and reference point selected according to S100 of FIG. 2.

As shown in FIG. 3, in step S100, the display panel can be divided into 2n−1 squares with equal area along its horizontal central axis (i.e., the arrow line passing through the display panel horizontally in FIG. 3), wherein n≥2. Then, the central point of each square is selected as the measurement point, and the central point of square n (i.e., the central point of the whole display panel) is specified as the reference point. In the present example, in order to achieve high correction accuracy, the gray-scale brightness curve of the reference point is preferably adjusted to meet the standard of γ 2.2. Of course, the present disclosure may not be limited by the standard.

In step S200, m gray-scales of the display panel are selected, and specified as measurement gray-scales, referred to as Lq, wherein q=1, . . . , m. The following steps S201~S202 are performed under each measurement gray-scale.

In step S201, the brightness of the reference point under the measurement gray-scale Lq is detected, referred to as In(Lq).

In step S202, In(Lq) is deemed as reference brightness, and the actual gray-scale of each measurement point when the brightness thereof reaches In(Lq) is detected.

From the background of the disclosure hereinabove it can be known that, the brightness of the measurement points under the same measurement gray-scale are different owing to the distortion of the scanning signals. Conversely, while the brightness of the measurement points are the same, their corresponding actual gray-scales are different. The present disclosure aims to gray-scale correction for enabling the display panel having identical and uniform display brightness as much as possible. From this point of view, for measurement point x, if its brightness Ix(y') equals to In(Lq) after its gray-scale is adjusted to y', that means the gray-scale of the measurement point should be corrected to y'. In this case, the gray-scale correction coefficient of measurement point x under gray-scale Lq should be Cx(Lq)=y'/Lq. That is to say, the gray-scale correction coefficient is the ratio of the actual gray-scale to the corresponding measurement gray-scale.

In step S300, the gray-scale correction coefficients of all measurement points under each measurement gray-scale are determined and collected, and the original gray-scale correction coefficient table is established. For the case of 2n−1 measurement points and m measurement gray-scales, there should be (2n−1)×m gray-scale correction coefficients in the original gray-scale correction coefficient table (as shown in FIG. 4). The gray-scale correction coefficient of the measurement point n identically equals to 1 under any gray-scale according to the definition of the gray-scale correction coefficient.

If a display panel has a resolution of M rows×N columns, the 2n−1 measurement points correspond to the $$\frac{N}{2n}, \frac{2N}{2n}, \ldots, \frac{pN}{2n}, \ldots, \frac{(2n-1)N}{2n}$$

pixel points arranged horizontally in the display panel respectively.

Strictly speaking, the measurement result of one measurement point represents the average value of all measurement results of the square region with the pixel point corresponding to said measurement point as its center. As it is impossible to measure one single pixel point in actual operation, the present disclosure proposes using the measurement result of a measurement point as the measurement result of the pixel point corresponding to said measurement point, which, however, will influence on the accuracy of the correction result inevitably. In view of this, measurement points and measurement gray-scales should be selected as more as possible in actual operation, so that as more as possible measurement results can be included in the original gray-scale correction coefficient table. In this case, correction accuracy as high as possible can be achieved.

The table as shown in FIG. 5 can be obtained through replacing measurement points in the table of FIG. 4 with pixel points corresponding to said measurement points (also referred to as measured pixel points). The table as shown in FIG. 5 is actually another expression form of the original gray-scale correction coefficient table.

In step S400, the original gray-scale correction coefficient table (as shown in FIG. 5) is extended to the gray-scale correction coefficient table of pixel points of the display panel under all gray-scales through linear interpolation algorithm. The thus-obtained extended gray-scale correction coefficient table should meet the following conditions:

i) the gray-scale correction coefficients of pixel points inserted between any two adjacent measurement points change linearly; and ii) the gray-scale correction coefficients of gray-scales inserted between any two adjacent measurement gray-scales change linearly.

In addition, the extended gray-scale correction coefficient table may preferably meet the following conditions:

iii) the gray-scale correction coefficient of the pixel point on the left side of the leftmost measurement point of the display panel equals to the gray-scale correction coefficient of the leftmost measurement point of the display panel; and iv) the gray-scale correction coefficient of the pixel point on the right side of the rightmost measurement point of the display panel equals to the gray-scale correction coefficient of the rightmost measurement point of the display panel.

It is necessary to explain that the phenomenon of "becoming white near the left and right sides" means that the pixel points of the display panel present different brightness in the horizontal direction of the display panel under the same gray-scale. Therefore, when a gray-scale correction is carried out for reducing the phenomenon of "becoming white near the left and right sides", the gray-scale correction coefficients of the pixel points in the same column of the display panel may be the same.

Based on the above principle, the original gray-scale correction coefficient table as shown in FIG. 5 can be extended to the gray-scale correction coefficient table of pixel points of the display panel under all gray-scales as shown in FIG. 6 (referred to as the extended gray-scale correction coefficient table for short). All inserted values in the table can be determined by the following equations:

$$C_x(L_q) = A(x)C_{\frac{(p+1)N}{2n}}(L_q) + [1 - A(x)]C_{\frac{pN}{2n}}(L_q)$$

$$C_{\frac{pN}{2n}}(y) = B(y)C_{\frac{pN}{2n}}(L_{q+1}) + [1 - B(y)]C_{\frac{pN}{2n}}(L_q)$$

$$C_x(y) = A(x)B(y)C_{\frac{(p+1)N}{2n}}(L_{q+1}) + [1 - A(x)]B(y)C_{\frac{pN}{2n}}(L_{q+1}) + A(x)[1 - B(y)]C_{\frac{(p+1)N}{2n}}(L_q) + [1 - A(x)][1 - B(y)]C_{\frac{pN}{2n}}(L_q)$$

$$A(x) = \frac{2nx}{N} - p,$$

$$B(y) = \frac{y - L_q}{L_{q+1} - L_q}$$

wherein $L_q$ and $L_{q+1}$ represent two adjacent measurement gray-scales;

$$\frac{pN}{2n} \text{ and } \frac{(p+1)N}{2n}$$

represent two adjacent measurement pixel points; and

Cx(y) represents the gray-scale correction coefficient of pixel point x under gray-scale y.

In step S500, the extended gray-scale correction coefficient table can be preset in control unit of liquid crystal display panel. When the data driving unit of the liquid crystal display panel writes in data signal to a pixel unit under a gray-scale, the control unit of the liquid crystal display panel will search the gray-scale correction coefficient corresponding to said gray-scale and said pixel point from the extended gray-scale correction coefficient table. If the gray-scale correction coefficient corresponding to gray-scale y and pixel point x is Cx(y) in the extended gray-scale correction coefficient table, the gray-scale y should be modified into y'=Cx(y)×y. Then the data driving unit is driven according to gray-scale y' to input data signals to pixel point x.

The aforesaid gray-scale correction method of the display panel will be explained further in the following with reference to a specific embodiment. A display panel with a resolution of 1080 rows×1920 columns is taken as an example, wherein N=1920.

The display panel is divided into 3 squares with equal area along its horizontal central axis, i.e., n=2. The central point of each square is selected as the measurement point, and the central point of square 2 (i.e., the central point of the whole display panel) is specified as the reference point.

Three gray-scales 48, 96, and 160 are selected as measurement gray-scales, i.e., m=3. Under each measurement gray-scale, the brightness of the reference point is measured, and then actual gray-scale of each measurement point when the brightness thereof reaches a reference brightness is measure, wherein the reference brightness is the brightness of the reference point. Taking gray-scale 48 for example, if the brightness of the reference point is $I_2(48)$=30.0 nit under gray-scale 48, and the brightness of the first measurement point is $I_1(41)$=30.0 nit only under gray-scale 41, the gray-scale of the first measurement point should be corrected from 48 to 41. In this case, the gray-scale correction coefficient of the first measurement point under gray-scale 48 is $$C_1(48) = \frac{41}{48} = 0.85.$$

The gray-scale correction coefficients of other measurement points under each measurement gray-scale can be obtained in the same way, so that original gray-scale correction coefficient table can be established accordingly (as shown in FIG. 7). The table as shown in FIG. 7 can be rewritten into the table as shown in FIG. 8.

The gray-scale correction coefficients of inserted pixel points and inserted gray-scales can be determined by the equations hereinabove. Taking pixel points in column 1015 and gray-scale 137 for example, wherein pixel points in column 1015 are located between pixel points in column 960 and pixel points in column 1440, and gray-scale 137 is located between gray-scale 96 and gray-scale 160.

Here, $$x = 1015,$$

$$p = 2,$$

$$A(x) = 0.1146;$$

$$y = 137,$$

$$Lq = 96,$$

$$Lq + 1 = 160,$$

$$B(y) = 0.6406.$$

$$C_{1015}(96) = 0.1146 \times C_{1440}(96) + (1 - 0.1146) \times C_{960}(96)$$

$$C_{960}(137) = 0.6406 \times C_{960}(160) + (1 - 0.6406) \times C_{960}(96)$$

-continued $$C_{1015}(137) = 0.1146 \times 0.6406 \times C_{1440}(160) + (1 - 0.1146) \times 0.6406 + C_{960}(160) + 0.1146 \times (1 - 0.6406) \times C_{1440}(96) + (1 - 0.1146) \times (1 - 0.6406) \times C_{960}(96)$$

The gray-scale correction coefficient of 1920 pixel points in the horizontal direction of the display panel under a total of 256 gray-scales can be obtained accordingly.

Then, the extended gray-scale correction coefficient table as shown in FIG. 9 can be built into the System on Chip of televisions or into the control unit of the liquid crystal display panels. When the data driving unit writes in data signal to pixel point 1015 of each row of the display panel under gray-scale 137, the gray-scale should be rewritten into $y' = C_{1015}(137) \times 137 = 0.97 \times 137 = 133$, and then the data signal is output to pixel point 1015 under gray-scale 133.

The present disclosure discloses the embodiments hereinabove, but the embodiments are adopted to facilitate the understanding of the present disclosure, rather than to limit it. Any one skilled in the art may make any modifications and changes to the forms and details of the embodiments without departing from the spirit and scope of the present disclosure. The extent of protection of the present disclosure shall be determined by the scope as defined in the claims.

The invention claimed is:

1. A method for correcting gray-scale of a display panel, comprising the steps of:

S100, selecting a plurality of measurement points of the display panel and specifying a reference point;

S200, specifying a plurality of measurement gray-scales, and, under each measurement gray-scale, measuring actual gray-scale of each measurement point when the brightness thereof reaches a reference brightness, wherein the reference brightness is the brightness of the reference point;

S300, determining a gray-scale correction coefficient of each measurement point under each measurement gray-scale according to the corresponding relationship between the actual gray-scale and the measurement gray-scale, and establishing an original gray-scale correction coefficient table;

S400, extending the original gray-scale correction coefficient table to a gray-scale correction coefficient table of pixel points of the display panel under all gray-scales through linear interpolation algorithm; and S500, when a data voltage is to be applied to a pixel point under a gray-scale, searching the gray-scale correction coefficient corresponding to said gray-scale and said pixel point from the extended gray-scale correction coefficient table, correcting the value of said gray-scale accordingly, and driving the display panel according to the corrected gray-scale, wherein the gray-scale correction coefficients inserted in the extended gray-scale correction coefficient table in step S400 are determined by the following equations:

$$C_x(L_q) = A(x)C_{\frac{(p+1)N}{2n}}(L_q) + [1 - A(x)]C_{\frac{pN}{2n}}(L_q)$$

$$C_{\frac{pN}{2n}}(y) = B(y)C_{\frac{pN}{2n}}(L_{q+1}) + [1 - B(y)]C_{\frac{pN}{2n}}(L_q)$$

$$C_x(y) = A(x)B(y)C_{\frac{(p+1)N}{2n}}(L_{q+1}) + [1 - A(x)]B(y)C_{\frac{pN}{2n}}(L_{q+1}) +$$

-continued $$A(x)[1-B(y)]C_{\frac{(p+1)N}{2n}}(L_q)+[1-A(x)][1-B(y)]C_{\frac{pN}{2n}}(L_q)$$

$$A(x)=\frac{2nx}{N}-p,$$

$$B(y)=\frac{y-L_q}{L_{q+1}-L_q}$$

wherein $L_q$ and $L_{q+1}$ represent two adjacent measurement gray-scales;

$$\frac{pN}{2n} \text{ and } \frac{(p+1)N}{2n}$$

represent two adjacent measurement pixel points;

$C_x(y)$ represents the gray-scale correction coefficient of pixel point x under gray-scale y; and N represents the column number of the display panel, and 2n−1 represents the number of measurement points, and p is an integer.

2. The method of claim 1, wherein the gray-scale correction coefficients of pixel points in the same column of the display panel are the same.

3. The method of claim 2, wherein said step S100 comprises:

dividing the display panel into 2n−1 squares with equal area along its horizontal central axis, wherein n≥2, and selecting the central point of each square as the measurement point, and specifying the central point of square n as the reference point.

4. The method of claim 2, wherein in step S400 the original gray-scale correction coefficient table is extended through linear interpolation algorithm, and in the extended gray-scale correction coefficient table:

the gray-scale correction coefficients of pixel points between any two adjacent measurement points change linearly; and the gray-scale correction coefficients of gray-scales between any two adjacent measurement gray-scales change linearly.

5. The method of claim 1, wherein said step S100 further comprises:

adjusting the gray-scale brightness curve of the reference point to meet the standard of γ 2.2.

6. The method of claim 1, wherein said step S100 comprises:

dividing the display panel into 2n−1 squares with equal area along its horizontal central axis, wherein n≥2, and selecting the central point of each square as the measurement point, and specifying the central point of square n as the reference point.

7. The method of claim 6, wherein in step S400 the original gray-scale correction coefficient table is extended through linear interpolation algorithm, and in the extended gray-scale correction coefficient table:

the gray-scale correction coefficients of pixel points between any two adjacent measurement points change linearly; and the gray-scale correction coefficients of gray-scales between any two adjacent measurement gray-scales change linearly.

8. The method of claim 6, wherein in step S400 the original gray-scale correction coefficient table is extended through linear interpolation algorithm, and in the extended gray-scale correction coefficient table:

the gray-scale correction coefficient of the pixel point on the left side of the leftmost measurement point of the display panel equals to the gray-scale correction coefficient of the leftmost measurement point of the display panel; and the gray-scale correction coefficient of the pixel point on the right side of the rightmost measurement point of the display panel equals to the gray-scale correction coefficient of the rightmost measurement point of the display panel.

9. The method of claim 6, wherein in step S400 the original gray-scale correction coefficient table is extended through linear interpolation algorithm, and in the extended gray-scale correction coefficient table:

the gray-scale correction coefficient of gray-scale smaller than the minimum measurement gray-scale equals to the gray-scale correction coefficient of the minimum measurement gray-scale; and the gray-scale correction coefficient of gray-scale larger than the maximum measurement gray-scale equals to the gray-scale correction coefficient of the maximum measurement gray-scale.

10. The method of claim 1, wherein the gray-scale correction coefficient in S300 is the ratio of the actual gray-scale to the corresponding measurement gray-scale.

11. The method of claim 1, wherein in step S400 the original gray-scale correction coefficient table is extended through linear interpolation algorithm, and in the extended gray-scale correction coefficient table:

the gray-scale correction coefficients of pixel points between any two adjacent measurement points change linearly; and the gray-scale correction coefficients of gray-scales between any two adjacent measurement gray-scales change linearly.

12. The method of claim 11, wherein in step S400 the original gray-scale correction coefficient table is extended through linear interpolation algorithm, and in the extended gray-scale correction coefficient table:

the gray-scale correction coefficient of the pixel point on the left side of the leftmost measurement point of the display panel equals to the gray-scale correction coefficient of the leftmost measurement point of the display panel; and the gray-scale correction coefficient of the pixel point on the right side of the rightmost measurement point of the display panel equals to the gray-scale correction coefficient of the rightmost measurement point of the display panel.

13. The method of claim 11, wherein in step S400 the original gray-scale correction coefficient table is extended through linear interpolation algorithm, and in the extended gray-scale correction coefficient table:

the gray-scale correction coefficient of gray-scale smaller than the minimum measurement gray-scale equals to the gray-scale correction coefficient of the minimum measurement gray-scale; and the gray-scale correction coefficient of gray-scale larger than the maximum measurement gray-scale equals to the gray-scale correction coefficient of the maximum measurement gray-scale.

14. The method of claim 1, wherein in step S400 the original gray-scale correction coefficient table is extended through linear interpolation algorithm, and in the extended gray-scale correction coefficient table:

the gray-scale correction coefficient of the pixel point on the left side of the leftmost measurement point of the display panel equals to the gray-scale correction coefficient of the leftmost measurement point of the display panel; and the gray-scale correction coefficient of the pixel point on the right side of the rightmost measurement point of the display panel equals to the gray-scale correction coefficient of the rightmost measurement point of the display panel.

15. The method of claim 14, wherein in step S400 the original gray-scale correction coefficient table is extended through linear interpolation algorithm, and in the extended gray-scale correction coefficient table:

the gray-scale correction coefficient of gray-scale smaller than the minimum measurement gray-scale equals to the gray-scale correction coefficient of the minimum measurement gray-scale; and the gray-scale correction coefficient of gray-scale larger than the maximum measurement gray-scale equals to the gray-scale correction coefficient of the maximum measurement gray-scale.

16. The method of claim 1, wherein in step S400 the original gray-scale correction coefficient table is extended through linear interpolation algorithm, and in the extended gray-scale correction coefficient table:

the gray-scale correction coefficient of gray-scale smaller than the minimum measurement gray-scale equals to the gray-scale correction coefficient of the minimum measurement gray-scale; and the gray-scale correction coefficient of gray-scale larger than the maximum measurement gray-scale equals to the gray-scale correction coefficient of the maximum measurement gray-scale.

17. The method of claim 1, wherein in step S500, the corrected gray-scale is the product of the original gray-scale and the gray-scale correction coefficient.

* * * * *